US005800001A

United States Patent [19]

Anastasi

[11] Patent Number: 5,800,001

[45] Date of Patent: Sep. 1, 1998

[54] ARTICLE CARRIER

[76] Inventor: Marguerite V. Anastasi, 5110 Flanders Ave., Kensington, Md. 20895-1109

[21] Appl. No.: 977,276

[22] Filed: Nov. 24, 1997

Related U.S. Application Data

[60] Provisional application No. 60/047,940 May 29, 1997.

[51] Int. Cl.[6] ..... A45F 5/10; B65D 37/00

[52] U.S. Cl. ..... 294/152; 294/141; 294/146

[58] Field of Search ..... 294/1.1, 138, 141, 294/142, 146, 148–157, 165; 150/154; 190/102, 103, 115, 117; 224/250, 257, 602

[56] References Cited

U.S. PATENT DOCUMENTS

| | | | |
|---|---|---|---|
| 399,979 | 3/1889 | Dyrenforth . | |
| 841,902 | 1/1907 | Shumard | 294/152 X |
| 954,840 | 4/1910 | Wiedemann | 294/152 X |
| 1,121,566 | 12/1914 | McKee | 294/138 |
| 1,373,136 | 3/1921 | Kranz | 294/138 |
| 1,971,322 | 8/1934 | Miller . | |
| 2,686,580 | 8/1954 | Donnelly . | |
| 2,723,067 | 11/1955 | Fretz | 294/152 |
| 3,489,194 | 1/1970 | Hoover . | |
| 5,251,945 | 10/1993 | Stoops | 294/152 |
| 5,409,282 | 4/1995 | Bale | 294/152 |

*Primary Examiner*—Johnny D. Cherry
*Attorney, Agent, or Firm*—Donald A. Kettlestrings

[57] ABSTRACT

An article carrier adapted for carrying a pillow includes a flexible sheet of material which defines two slotted openings adjacent to opposed edges of the material. Two flexible carrying elements are connected to the material adjacent to the slotted openings. A pillow or other item can be placed onto the material and the material folded in a predetermined manner with carrying elements extending through the slotted openings so that the pillow or other item is retained within the carrier while the carrier is held by the carrying elements. Pillows of different sizes can be accommodated by folding the material of the article carrier in different ways.

21 Claims, 5 Drawing Sheets

ARTICLE CARRIER

This application claims the benefit of U.S. Provisional application Ser. No. 60/047,940, filed May 29, 1997.

BACKGROUND OF THE INVENTION

This invention relates to an article carrier and more particularly to a carrier for pillows.

Travelers often prefer to carry their own pillow for use during travel and for use after reaching their destination. Use of a pillow while traveling in an automobile, train, ship or airplane can increase a traveler's comfort, and travelers may often prefer to carry and use their own familiar and comfortable pillow. However, carrying a king size, queen size or regular size pillow has heretofore been difficult because the pillows are cumbersome and difficult to carry conveniently and are often soiled or damaged during travel.

It is, therefore, an object of the present invention to provide an article carrier particularly adapted for carrying pillows.

Another object is to provide such a pillow carrier which is light weight and which can be folded into a small space or volume when not in use.

A further object of the invention is the provision of such a pillow carrier which enables pillows of varying sizes to be easily and conveniently carried.

Yet another object of the present invention is the provision of such a pillow carrier which can be easily manipulated into different configurations and sizes for carrying king size, queen size or regular size pillows.

Another object is to provide such a pillow carrier which enables a pillow to be carried without soiling or damaging the pillow.

Still another object is to provide such a pillow carrier which can be easily manipulated in cooperation with the pillow being carried for convenient normal use of the pillow by a traveler without removal of the pillow from the carrier.

Another object is to provide quick and easy access to a pillow which is carried by the article carrier of this invention so that the pillow can be used during travel while still retained within the carrier.

A further object is to provide a minimum weight, compact, neat appearing and hand freeing carrier for a pillow.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides an article carrier, comprising: a flexible sheet of predetermined material and at least a first predetermined thickness defining first and second opposed sides, first and second opposed edges, and third and fourth opposed edges extending between the first and second edges; the sheet defining a first slotted opening extending between the first and second sides and positioned adjacent to the first edge, and a second slotted opening extending between the first and second sides and positioned adjacent to the second edge; a first flexible carrying element connected to the first side at first predetermined locations adjacent to the first slotted opening, the first slotted opening positioned between the first edge and the first locations; and a second flexible carrying element connected to the first side at second predetermined locations adjacent to the second slotted opening, the second slotted opening positioned between the second edge and the second locations.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DESCRIPTION OF THE PREFERRED EMBODIMENT

Figure 1:
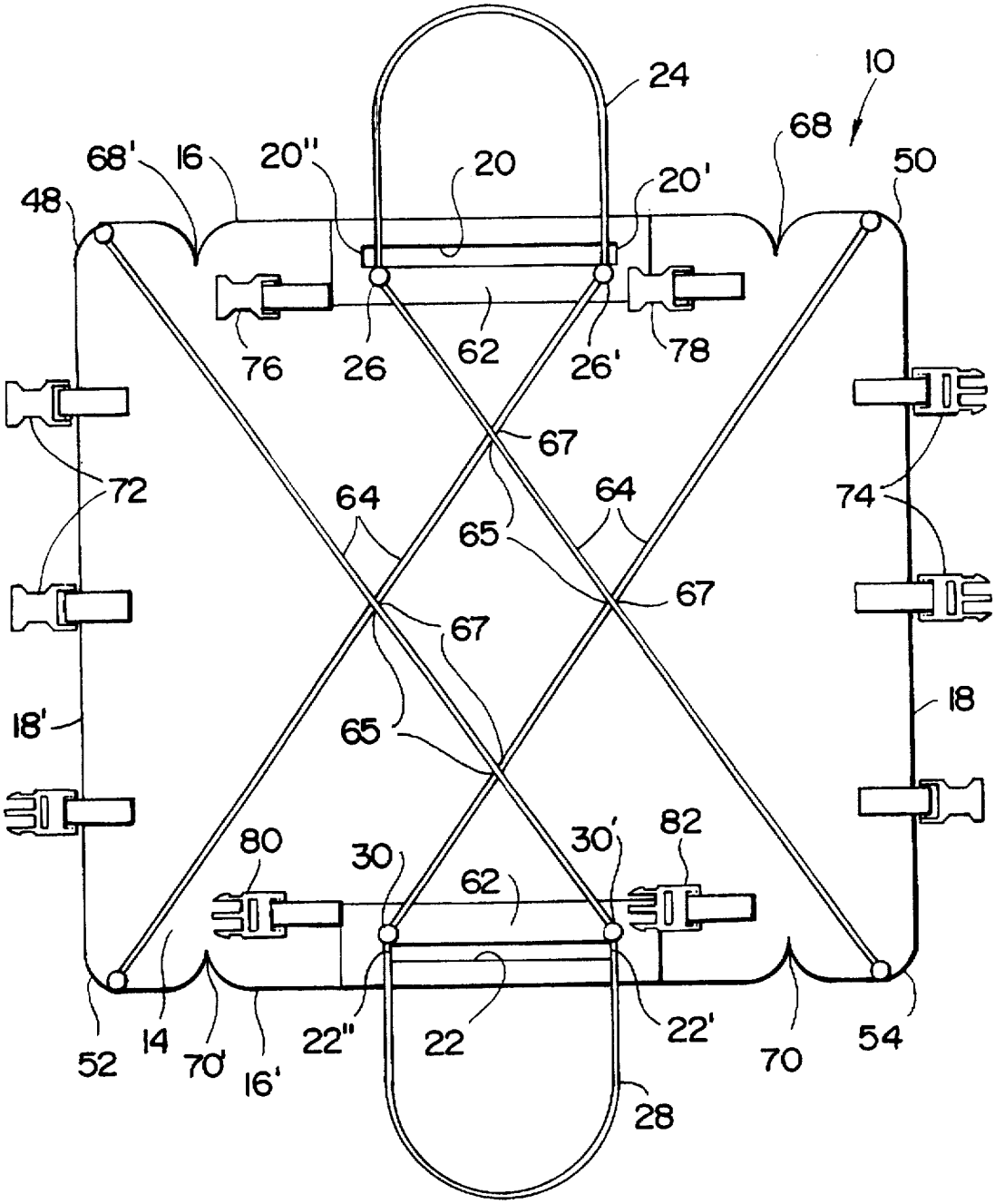
FIG. 1 is a plan view showing a first side of an article carrier in accordance with the invention.

With reference now to the drawings, wherein like reference characters designate like or corresponding parts throughout the several views, there is shown an article carrier 10 according to the present invention. Carrier 10 is particularly adapted for carrying pillows, and carrier 10 includes a flexible rectangular sheet 12 of predetermined material, such as plastic, heavyweight canvas, cotton twill, ripstop nylon, leather or other suitable material commonly used for soft luggage. Sheet 12 defines a first predetermined thickness and defines first and second opposed sides 14, 14'. Sheet 12 further defines first and second opposed edges 16, 16' and third and fourth opposed edges 18, 18' extending between edges 16, 16'.

In accordance with the invention, sheet 12 further defines a first slotted opening 20 extending between sides 14, 14' and positioned adjacent to first edge 16. Sheet 12 also defines a second slotted opening 22 extending between sides 14, 14' and positioned adjacent to second edge 16'.

A first flexible carrying element, cord or strap 24 is connected by rivets to first side 14 at first predetermined locations 26, 26' adjacent to slotted opening 20, and slotted opening 20 is positioned between edge 16 and locations 26, 26'.

A second flexible carrying element, cord or strap 28 is connected by rivets to first side 14 at second predetermined locations 30, 30' adjacent to slotted opening 22, and slotted opening 22 is positioned between edge 16' and locations 30, 30'.

A first article-retaining strap 32 is preferably removably connected to second side 14' and extends between a third location 34 substantially midway between edges 16, 16' and a fourth location 36 adjacent to opening 20. A second article-retaining strap 38 is preferably removably connected to side 14' and extends between a fifth location 40 substantially midway between edges 16, 16' and a sixth location 42 adjacent to opening 20. Straps 32, 38 are preferably conventional elastic straps to accommodate and hold a pillow.

Figure 4:
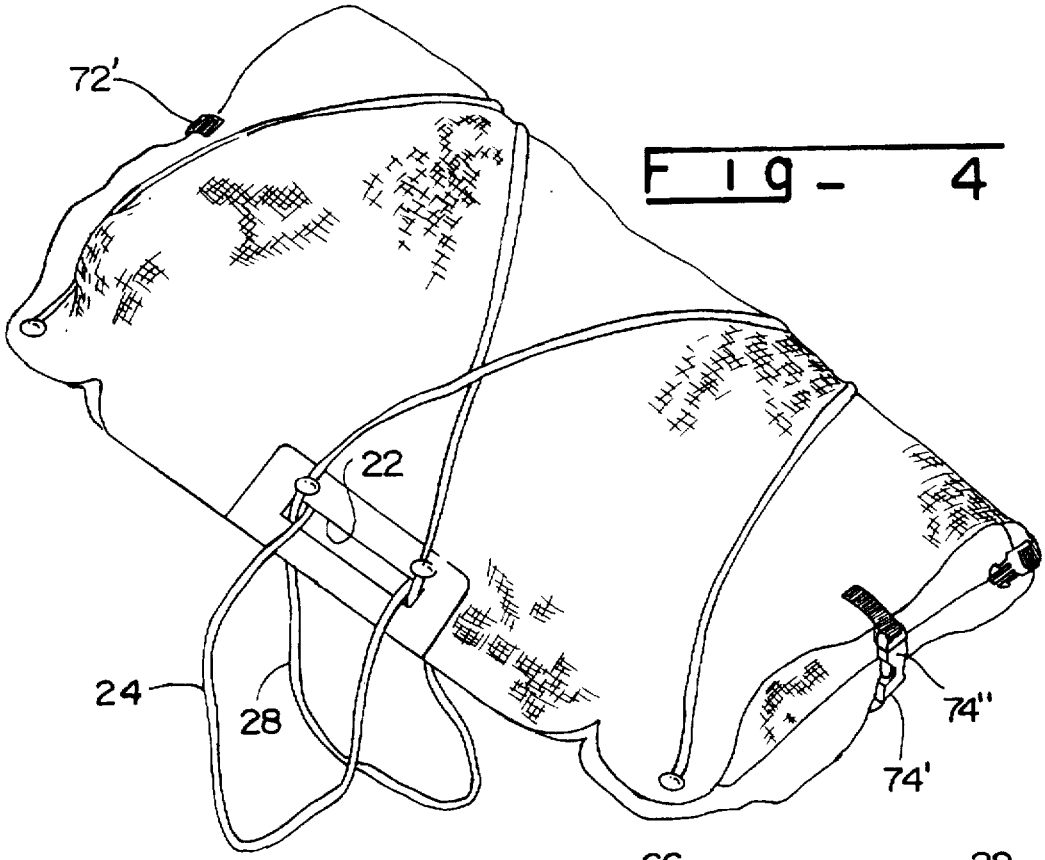
FIG. 4 is a perspective view showing the article carrier holding a king size pillow and folded for carrying the pillow.

Article carrier 10 further includes first connecting means 44 attached by glue or other conventional means on side 14' of sheet 12 adjacent to opening 20 and second connecting means 46 attached by glue or other conventional means on side 14' of sheet 12 adjacent to opening 22 for removably connecting together connecting means 44, 46 when flexible sheet 12 is folded in a predetermined manner shown in FIG. 4.

Edges 16, 16', 18 and 18' form first, second, third and fourth corners 48, 50, 52 and 54, respectively, of sheet 12, and article carrier 10 further includes third connecting means 56 attached by glue or other conventional means to side 14' of sheet 12 adjacent to first and second corners 48, 50. Article carrier 10 also includes fourth connecting means 58 attached by glue or other conventional means to side 14' of sheet 12 adjacent to corners 52, 54 for connecting third connecting means 56 to fourth connecting means 58 when flexible sheet 12 is folded in the manner shown in FIG. 4.

Each of slotted openings 20, 22 is preferably an elongate, narrow opening which defines opposed ends 20', 20" and 22', 22", respectively. In accordance with the invention, first predetermined locations 26, 26' are each located a first predetermined distance from ends 20", 20', respectively, of opening 20. Similarly, second predetermined locations 30, 30' are each located a second predetermined distance from opposed ends 22", 22', respectively, of opening 22. The first predetermined distance spacing of locations 26, 26' from ends 20", 20' is greater than the second predetermined distance spacing of locations 30, 30' from ends 22", 22' to facilitate non-interfering cooperation of carrying elements 24, 28 when the carrying elements are each inserted through both openings 20, 22 in a manner for closing and securing carrier 10 and for enabling carrier 10 to be transported by a person grasping carrying elements 24, 28. This procedure is explained in more detail below.

Sheet 12 preferably defines a second predetermined thickness, greater than the first predetermined thickness, in first predetermined areas 60 around the perimeter of carrier 10 adjacent to edges 16, 16', 18 and 18'. This provides increased sturdiness and strength and prevents tearing or fraying of sheet 12. The increased thickness is preferably created by laminating at least an additional layer of sheet 12 material by glue in area 60.

Carrier 10 also preferably defines a third predetermined thickness greater than the first and second predetermined thicknesses in second predetermined areas 62 adjacent to edges 16, 16' and adjacent to and surrounding openings 20, 22. The increased thickness is preferably created by laminating a plurality of layers of sheet 12 material by glue in area 62. This provides increased sturdiness, strength and increased rigidity around openings 20, 22 so that openings 20, 22 can act as handles for carrier 10. This increased sturdiness also facilitates quick and easy insertion and removal of cords or straps 24, 28 with respect to openings 20, 22.

Carrier 10 also preferably includes a plurality of cords 64 connected to side 14 of sheet 12 for providing increased strength and support to sheet 12. Cords 64 are preferably glued by use of conventional glue along their entire lengths to sheet 12, and carrying elements 24, 28 are preferably connected to predetermined ones of cords 64. In the preferred embodiment, carrying elements 24, 28 are extensions of cords 64 and are comprised of the same material as cords 64.

One or more pockets 66 can be connected to side 14' and sheet 12 in a conventional manner.

Further in accordance with the invention, edge 16 preferably defines first and second notches 68, 68' therein and edge 16' preferably defines third and fourth notches 70, 70' therein for facilitating folding of sheet 12 along two imaginary lines 21, 21' connecting notches 68, 70 and connecting notches 68', 70'. Notches 68, 70 are each located a first equal distance from edge 18. Notches 68', 70' are each located a second equal distance from edge 18', and the first and second distances are preferably the same.

Article carrier 10 also includes at least two first connecting elements 72 attached to sheet 12 in a conventional manner by glue or otherwise adjacent to edge 18' of sheet 12. Carrier 10 further includes at least two second connecting elements 74 attached to sheet 12 in a conventional manner by glue or otherwise adjacent to edge 18 of sheet 12 so that connecting elements 72, 74 can be removably connected together to retain an article within sheet 12 when sheet 12 is folded in a first predetermined manner as shown in FIG. 4. It is preferred that three each of connecting elements 72 and 74 be provided.

Carrier 10 preferably further includes a third connecting element 76 attached to side 14 of sheet 12 in a conventional manner by glue or otherwise a predetermined distance from and adjacent to first corner 48. A fourth connecting element 78 is preferably similarly attached to side 14 of sheet 12 a predetermined distance from and adjacent to second corner 50. Similarly, a fifth connecting element 80 is preferably attached to side 14 of sheet 12 a predetermined distance from and adjacent to third corner 52, and a sixth connecting element 82 is preferably similarly attached to side 14 of sheet 12 a predetermined distance from and adjacent to fourth corner 54. Connecting elements 76, 80 can be removably connected to each other and connecting elements 78, 82 can be removably connected to each other to retain an article, such as a pillow, within sheet 12 when the sheet is first folded in a first predetermined manner shown in FIG. 9 and then folded in a second predetermined manner illustrated in FIG. 10.

Article carrier 10 preferably further includes a seventh connecting element 84 attached in a conventional manner by glue or otherwise on second side 14' of sheet 12 adjacent to first corner 48. An eighth connecting element 86 is preferably similarly attached on second side 14' of sheet 12 adjacent to second corner 50, and a ninth connecting element 88 is preferably similarly attached on second side 14' of sheet 12 adjacent to opening 20. A tenth connecting element 90 is also preferably similarly attached on second side 14' of sheet 12 adjacent to opening 20, and connecting elements 84, 88 are releasably connected to each other and connecting elements 86, 90 are releasably connected to each other when flexible sheet 12 is folded in the predetermined manner illustrated in FIG. 9.

An eleventh connecting element 92 is preferably similarly attached on second side 14' of sheet 12 adjacent to third corner 52, and a twelfth connecting element 94 is preferably similarly attached on second side 14' of sheet 12 adjacent to fourth corner 54. A thirteenth connecting element 96 is preferably similarly attached on second side 14' of sheet 12 adjacent to second opening 22, and a fourteenth connecting element 98 is preferably similarly attached on second side 14' of sheet 12 adjacent to opening 22. Connecting elements 92, 96 can be releasably connected to each other and connecting elements 94, 98 can be releasably connected to each other when flexible sheet 12 is folded in the predetermined manner illustrated in FIG. 9.

Sheet 12 can be made from plastic, such as polyurethane chloride, and the polyurethane chloride is preferably eight gauge printable polyurethane chloride. Alternatively, sheet 12 can be made from heavyweight canvas, cotton twill or other suitable material, and cords or braiding 64 are preferably made of jute, cotton, leather or plastic. Conventional vinyl glue, such as Instant Vinyl® is used to attach cords or braids 64 to plastic sheet 12. The glue must be flexible to allow for movement during use of article carrier 10. Other conventional glue can be used to attach cords or braids 64 to sheet 12 when sheet 12 is made from canvas, cotton twill or other suitable material. Rivets 65 also can be used at locations 67 where cords or braids 64 intersect each other to further hold the cords or braids in position on sheet 12.

Connectors 44, 46, 56, 58, and 72–98 can be conventional hook and loop type fasteners, such as Velcro®. Alternatively, connecting elements 72, 74 can be conventional plastic parachute buckles with buckles 72' and 74' being male buckles and with buckles 72" and 74" being female buckles.

Another alternate configuration provides for connectors 44, 46, 56, 58 and 84–98 being conventional snap connectors. In this alternative configuration, connectors 44, 58, 88, 90, 96 and 98 are preferably female snap connectors and connectors 46, 56, 84, 86, 92 and 94 are preferably male snap connectors.

Connectors 76, 78, 80 and 82 in an alternative configuration are preferably plastic parachute buckles with connectors 76, 78 being male parachute buckles and connectors 80, 82 being female parachute buckles.

When Velcro® connectors are used, connectors 58, 92 adjacent to cover 52 are combined into one Velcro® connector and connectors 58, 94 adjacent to corner 54 are combined into one Velcro® connector.

The preferred dimensions of sheet 12 are such that king, queen and regular size pillows can be carried by carrier 10. For example, the distance between edges 16, 16' is preferably thirty-six inches, and the distance between edges 18, 18' is preferably twenty-two inches. The distances between notches 68, 70 and edge 18 and between notches 68', 70' and edge 18' are each preferably five and one-quarter inches so that a queen size pillow will fit onto sheet 12 with the short dimension fitting between imaginary lines 21, 21' extending between notches 68,70 and notches 68', 70', respectively.

Figure 2:
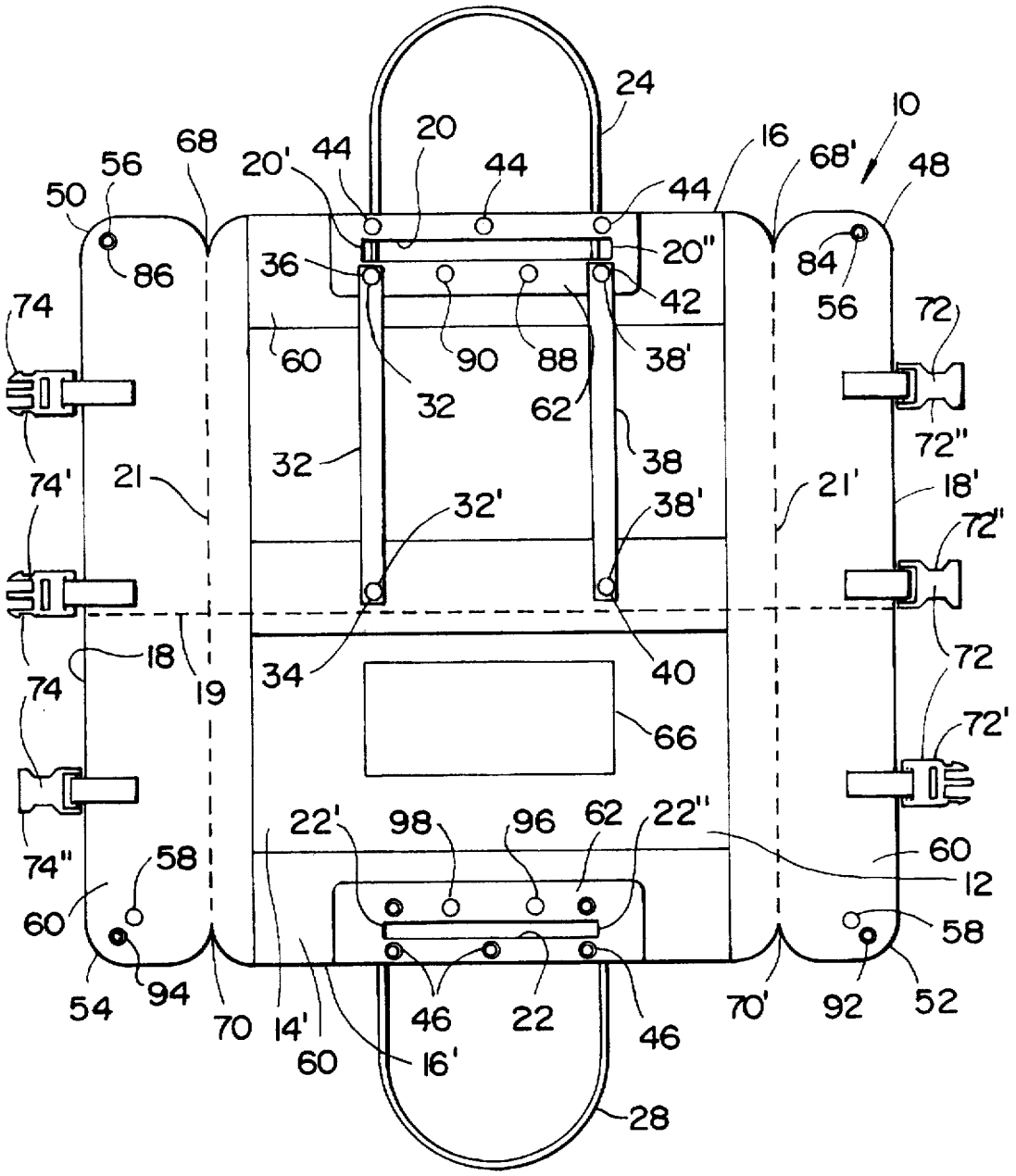
FIG. 2 is a plan view showing a second side of the article carrier.
Figure 3:
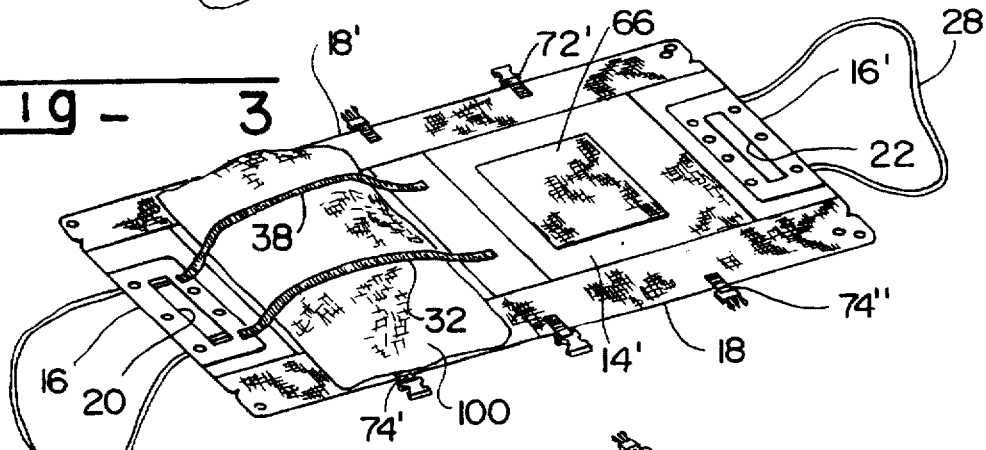
FIG. 3 is a perspective view showing the article carrier holding a king size pillow.

A first manner of using article carrier 10 for carrying a king size pillow 100 opens carrier 10 to a position shown in FIG. 2. A conventional king size pillow 100 is then placed onto side 14' of carrier 10, as shown in FIG. 3. The dimensions of sheet 12 and of a king size pillow are such that the pillow can be placed with its lengthwise dimensions extending between edges 18, 18' and parallel to edges 16, 16'. The smaller dimension of the conventional king size pillow will be positioned so that the pillow can be substantially centered on an area of sheet 12 bounded by edges 18, 18', edge 16 and an imaginary center line 19 which extends between edges 18, 18' and which is centered between edges 16, 16'. The pillow is preferably positioned under and is held in position by elastic straps 32, 38 which are fastened to sheet 12 by connectors 32', 38', respectively, on the ends of the straps being removably fastened to connectors 34, 36, 40, 42 on sheet 12, respectively.

Sheet 12 is then folded over the pillow and substantially about imaginary line 19 as shown in FIG. 4 so that openings 20, 22 are substantially aligned with each other. Connectors 44 can then be fastened to connectors 46, and connectors 72 can be fastened to connectors 74.

Flexible carrying element or handle 24 can then be passed first through opening 20 and then through opening 22, and flexible carrying element or handle 28 can be passed first through opening 22 and then through opening 20 so that handles 24, 28 can be simultaneously grasped and carrier 10 can be transported by grasping handles 24, 28. The grasping of handles 24, 28 which have been fed through both openings 20, 22 also further tightly holds edges 16, 16' together as carrier 10 is carried by the handles and enables the pillow to be firmly and protectively contained within sheet 12. The fastening together of connectors 72, 74 prevents the pillow from sliding outwardly to the side of carrier 10 as the pillow is transported by carrier 10.

Because of the relative positions of locations 26, 26', where handle 24 is connected to sheet 12, with respect to the positions of locations 30, 30', where handle 28 is connected to sheet 12, handles 24, 28 can each be freely passed through both of openings 20, 22 without the handles interfering with each other.

If three connectors 72 and three connectors 74 are used as preferred and as illustrated, each of the middle connectors of connectors 72, 74 is preferably located immediately adjacent to imaginary line 19 and not on line 19 to facilitate easy folding of sheet 12 about imaginary line 19.

Figure 5:
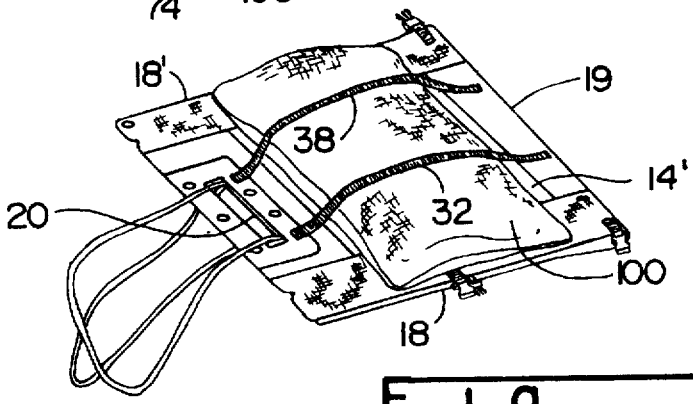
FIG. 5 is a perspective view showing the article carrier holding a king size pillow and folded for enabling normal use of the pillow.

A second manner of using article carrier 10 for holding a king size pillow 100 as the pillow is being normally used, instead of during transport of the pillow, is shown in FIG. 5 and positions the pillow on sheet 12 under straps 32, 38 as previously described. Sheet 12 is then folded substantially about imaginary center line 19 in the opposite direction from that previously described so that side 14 of sheet 12 faces itself and so that side 14' faces outwardly. The pillow held within carrier 10 by straps 32, 38 can then be used for its normal purposes as a pillow. After use of the pillow, carrier 10 can then be manipulated as previously described by refolding sheet 12 about center line 19 with side 14' facing itself so that side 14 faces outwardly, as shown in FIG. 4.

Figure 6:
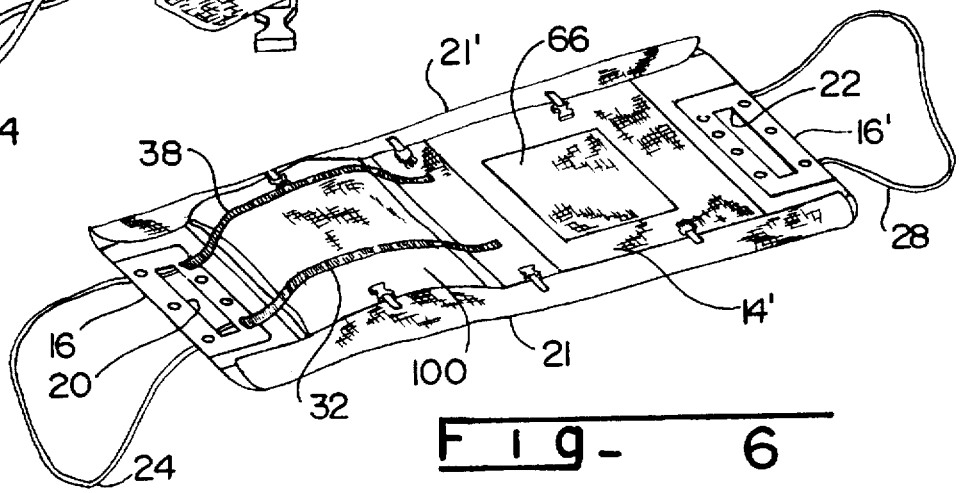
FIG. 6 is a perspective view showing the article carrier folded and holding a regular or queen size pillow.

Another manner of using article carrier 10 for carrying a queen or regular size pillow 100 first opens carrier 10 to a position shown in FIG. 2. Edges 18, 18' are then folded inwardly toward side 14' as shown in FIG. 6. Edge 18 is folded about an imaginary line 21 extending between notches 68, 70, and edge 18' is folded about an imaginary line 21' extending between notches 68', 70'.

A conventional queen or regular size pillow 100 is then placed onto side 14' of carrier 10, as shown in FIG. 6. The dimensions of sheet 12 with edges 18, 18' folded as described and the dimensions of a queen or regular size pillow are such that the pillow can be placed with its lengthwise dimension extending between the folded edges at imaginary lines 21, 21' and parallel to edges 16, 16'. The smaller dimension of the conventional queen or regular size pillow will be positioned so that the pillow can be substantially centered on an area of sheet 12 bounded by folded edges 21, 21', edge 16 and center line 19. The pillow is preferably positioned under and is held in position by elastic straps 32, 38 in the manner previously described with respect to use of carrier 10 with a king size pillow. The pillow can be positioned on top of or under the folded edges, but it is preferred that the pillow be placed under the folded edges, as shown in FIG. 6, so that the folded edges enclose and protect the pillow.

Sheet 12 is then folded over the pillow and substantially about center line 19 so that openings 20, 22 are substantially aligned with each other. See FIG. 7. Connectors 44 can then be fastened to connectors 46, and flexible handles 24, 28 can be passed through openings 20, 22 in the same manner as previously described with respect to use of carrier 10 with a king size pillow.

Another manner of holding a queen or regular size pillow on carrier 10 for normal use of the pillow as the pillow is held by carrier 10 instead of during transport of the pillow positions the queen or regular size pillow onto carrier 10 in the same manner as previously described and shown in FIG. 6. In this manner of use, however, it is preferred that the pillow be placed over the folded edges so that the entire pillow is accessible for normal use of the pillow.

Figure 7:
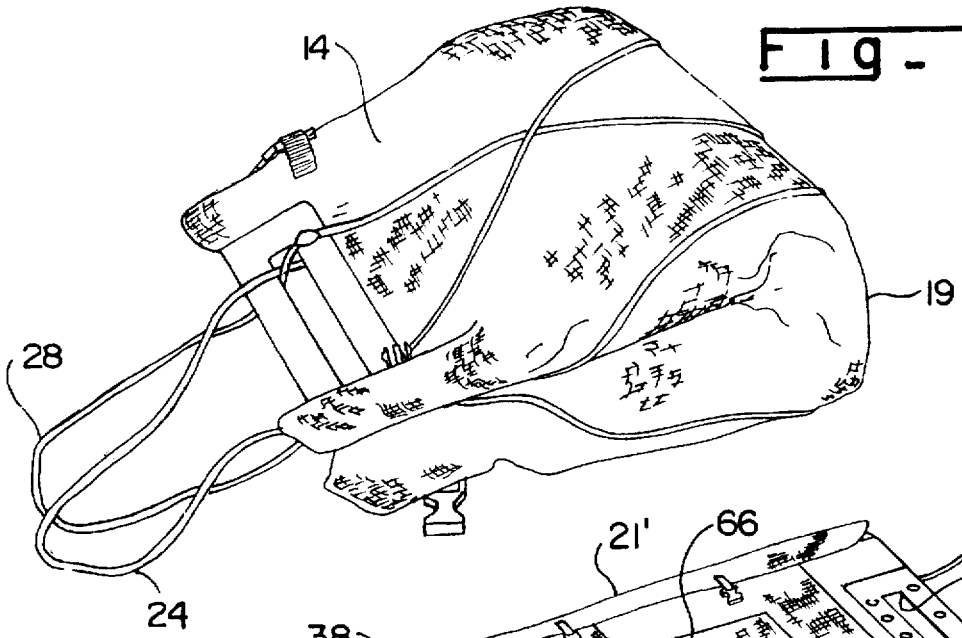
FIG. 7 is a perspective view showing the article carrier holding a regular or queen size pillow and folded for carrying the pillow.
Figure 8:
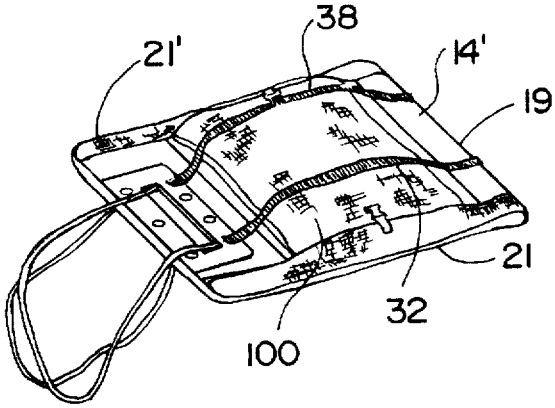
FIG. 8 is a perspective view showing the article carrier holding a regular or queen size pillow and folded for enabling normal use of the pillow.

Sheet 12 is then folded substantially about center line 19 with side 14 folded together and with side 14' facing outwardly. The queen or regular size pillow held by straps 32, 38 can then be used by the traveler in its normal fashion as shown in FIG. 8. After use of the pillow, carrier 10 can be manipulated as previously described by refolding sheet 12 about center line 19 with side 14' facing itself and with side 14 facing outwardly, as shown in FIG. 7.

Another manner of using article carrier 10 for carrying a king, queen or regular size pillow 100 first opens carrier 10 to a position shown in FIG. 2. A conventional king, queen or regular size pillow is then placed on side 14' of carrier 10. The pillow is placed with its lengthwise dimension extending substantially parallel to edges 18, 18', and the pillow is preferably positioned so that it is substantially centered over center line 19.

Figure 9:
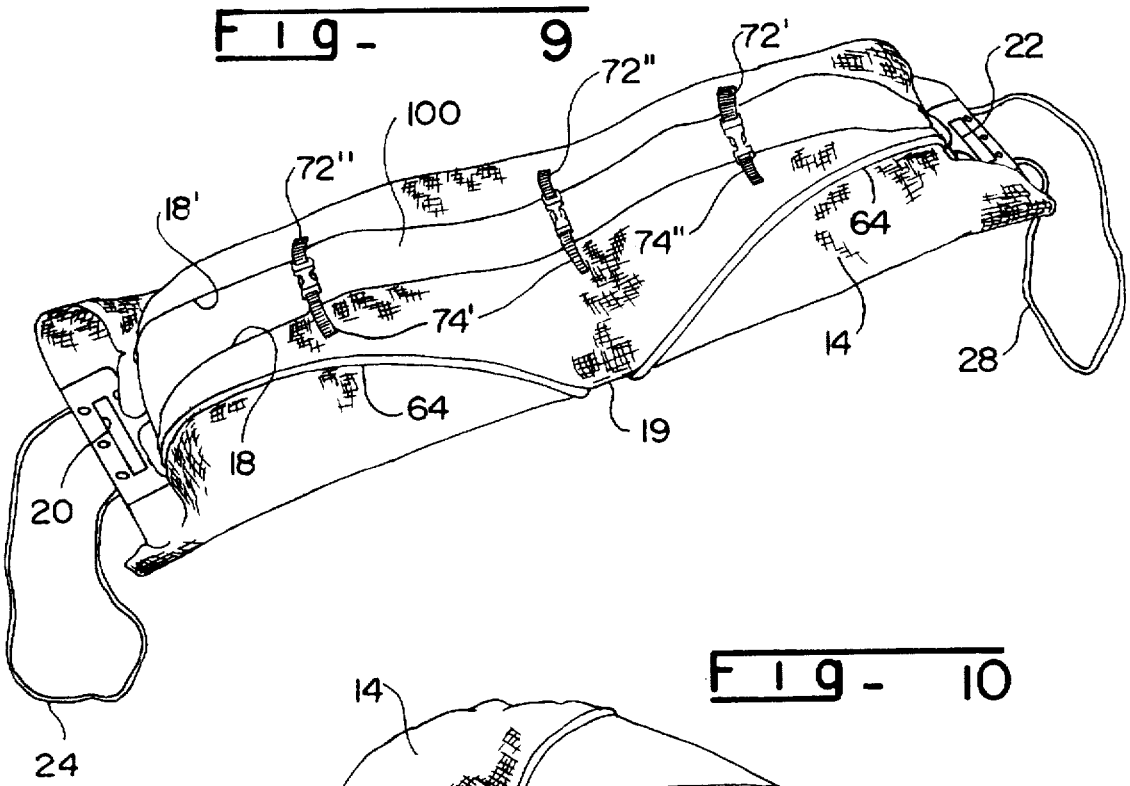
FIG. 9 is a perspective view showing the article carrier folded and holding a regular, queen or king size pillow.

Edges 18, 18' are then folded inwardly toward side 14' and over the pillow. Connectors 72, 74 are then fastened together, and connectors 84, 88, connectors 86, 90, connectors 92, 96 and connectors 94, 98 are fastened together, respectively, as shown in FIG. 9.

Figure 10:
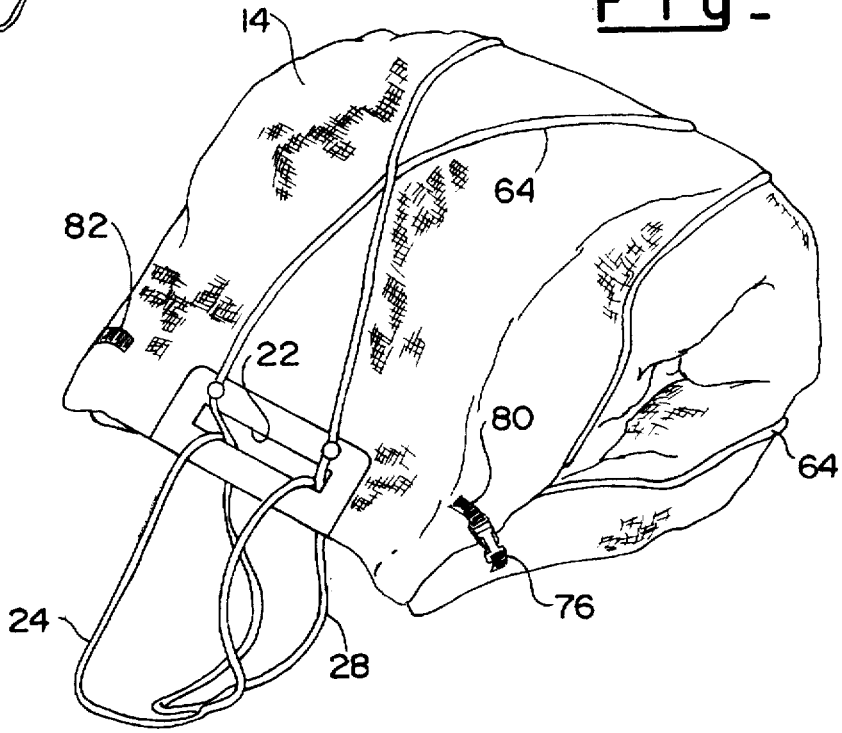
FIG. 10 is a perspective view showing the article carrier holding a regular, queen or king size pillow and folded for carrying the pillow.

Sheet 12 and the pillow are then together folded substantially about center line 19 as shown in FIG. 10 so that openings 20, 22 are substantially aligned with each other. Connectors 78, 82 are then fastened together and connectors 76, 80 are fastened together, and carrying elements or handles 24, 28 are then passed through openings 20, 22 in a manner as previously described.

Handles 24, 28 can be made long enough to permit the handles to be comfortably positioned on the shoulder of a person carrying carrier 10 so as to free up use of the person's hands.

This invention provides an article carrier which is particularly adapted for conveniently carrying king, queen or regular size pillows in a manner to provide protection for the pillows during travel and to provide quick and easy access to the pillows for removal from the article carrier or so the pillows can be used in their normal manner while still retained by the article carrier.

The invention in its broader aspects is not limited to the specific details shown and described, and departures may be made from such details without departing from the principles of the invention and without sacrificing its chief advantages.

What is claimed is:

1. An article carrier, comprising:

a flexible sheet of predetermined material and at least a first predetermined thickness defining first and second opposed sides, first and second opposed edges, and third and fourth opposed edges extending between said first and second edges;

said sheet defining a first slotted opening extending between said first and second sides and positioned adjacent to said first edge, and a second slotted opening extending between said first and second sides and positioned adjacent to said second edge;

a first flexible carrying element connected to said first side at first predetermined locations adjacent to said first slotted opening, said first slotted opening positioned between said first edge and said first locations; and a second flexible carrying element connected to said first side at second predetermined locations adjacent to said second slotted opening, said second slotted opening positioned between said second edge and said second locations.

2. An article carrier as in claim 1 further including:

a first article-retaining strap removably connected to said second side and extending between a third location substantially midway between said first and second edges and a fourth location adjacent to said first opening; and a second article-retaining strap removably connected to said second side and extending between a fifth location substantially midway between said first and second edges and a sixth location adjacent to said first opening.

3. An article carrier as in claim 2 further including first and second connecting means attached on said second side adjacent to said first and second openings, respectively, for removably connecting together said first and second connecting means when said flexible sheet is folded in a predetermined manner.

4. An article carrier as in claim 3 wherein said first, second, third and fourth edges form first, second, third and fourth corners of said sheet, and further including third connecting means attached on said second side adjacent to said first and second corners and fourth connecting means attached on said second side adjacent to said third and fourth corners for connecting said third connecting means to said fourth connecting means when said flexible sheet is folded in said predetermined manner.

5. An article carrier as in claim 4 wherein said first and second slotted openings each defines opposed ends and wherein said first and second slotted openings are of substantially the same shape and dimensions.

6. An article carrier as in claim 5 wherein said first predetermined locations are each substantially a first predetermined distance from said opposed ends of said first opening and wherein said second predetermined locations are each substantially a second predetermined distance from said opposed ends of said second opening, said first predetermined distance being greater than said second predetermined distance.

7. An article carrier as in claim 6 wherein said sheet defines a second predetermined thickness greater than said first predetermined thickness in first predetermined areas adjacent to said first, second, third and fourth edges.

8. An article carrier as in claim 7 wherein said sheet defines a third predetermined thickness greater than said first and second predetermined thicknesses in second predetermined areas adjacent to said first and second edges and adjacent to and surrounding said first and second openings.

9. An article carrier as in claim 8 further including a plurality of cords connected to said first side of said sheet for providing increased strength and support to said sheet.

10. An article carrier as in claim 9 wherein said first and second carrying elements are connected to predetermined ones of said cords.

11. An article carrier as in claim 10 further including a pocket connected to said second side of said sheet.

12. An article carrier as in claim 1 wherein said first edge defines first and second notches therein and wherein said second edge defines third and fourth notches therein for facilitating folding of said sheet along two imaginary lines connecting said first and third notches and connecting said second and fourth notches.

13. An article carrier as in claim 12 wherein said first and third notches are each located a substantially first equal distance from said third edge and wherein said second and fourth notches are each located a substantially second equal distance from said fourth edge.

14. An article carrier as in claim 13 wherein said first and second distances are substantially the same.

15. An article carrier as in claim 1 further including:

at least two first connecting elements attached to said sheet and adjacent to said fourth edge of said sheet; and at least two second connecting elements attached to said sheet and adjacent to said third edge of said sheet, whereby said first and second connecting elements can be removably connected to each other to retain an article within said sheet when said sheet is folded in a first or second predetermined manner.

16. An article carrier as in claim 15 wherein said first, second, third and fourth edges form first, second, third and fourth corners of said sheet and further including:

a third connecting element attached to said first side of said sheet a predetermined distance from and adjacent to said first corner;

a fourth connecting element attached to said first side of said sheet a predetermined distance from and adjacent to said second corner;

a fifth connecting element attached to said first side of said sheet a predetermined distance from and adjacent to said third corner; and a sixth connecting element attached to said first side of said sheet a predetermined distance from and adjacent to said fourth corner, whereby said third and fifth connecting elements can be removably connected to each other and said fourth and sixth connecting elements can be removably connected to each other to retain an article within said sheet when said sheet is first folded in said second predetermined manner and then folded in a third predetermined manner.

17. An article carrier as in claim 16 further including:

a seventh connecting element attached on said second side of said sheet adjacent to said first corner;

an eighth connecting element attached on said second side of said sheet adjacent to said second corner;

a ninth connecting element attached on said second side of said sheet adjacent to said first opening; and a tenth connecting element attached to said second side of said sheet adjacent to said first opening, whereby said seventh and ninth connecting elements are releasably connected to each other and said eighth and tenth connecting elements are releasably connected to each other when said flexible sheet is folded in said second predetermined manner.

18. An article carrier as in claim 17 further including:

an eleventh connecting element attached on said second side of said sheet adjacent to said third corner;

a twelfth connecting element attached on said second side of said sheet adjacent to said fourth corner;

a thirteenth connecting element attached on said second side of said sheet adjacent to said second opening; and a fourteenth connecting element attached on said second side of said sheet adjacent to said second opening, whereby said eleventh and thirteenth connecting elements are releasably connected to each other and said twelfth and fourteenth connecting elements are releasably connected to each other when said flexible sheet is folded in said second predetermined manner.

19. An article carrier as in claim 1 wherein said predetermined material is comprised of plastic.

20. An article carrier as in claim 19 wherein said plastic is comprised of polyurethane chloride.

21. An article carrier as in claim 20 wherein said polyurethane chloride is eight gauge, printable polyurethane chloride.

* * * * *